US007210477B2

(12) United States Patent
Templeton et al.

(10) Patent No.: US 7,210,477 B2
(45) Date of Patent: May 1, 2007

(54) RESPIRATOR HOOD ASSEMBLY

(75) Inventors: Randall D. Templeton, Kitchener (CA); David Snaith, King City (CA)

(73) Assignee: Brookdale International Systems, Inc., Vancouver, B.C. (CA)

( * ) Notice: Subject to any disclaimer, the term of this patent is extended or adjusted under 35 U.S.C. 154(b) by 0 days.

(21) Appl. No.: 10/448,180

(22) Filed: May 29, 2003

(65) Prior Publication Data

US 2004/0003810 A1 Jan. 8, 2004

Related U.S. Application Data

(60) Provisional application No. 60/383,815, filed on May 29, 2002.

(51) Int. Cl.
*A62B 18/00* (2006.01)
*A62B 7/10* (2006.01)

(52) U.S. Cl. ..... 128/201.22; 128/201.25

(58) Field of Classification Search ..... 128/201.22, 128/201.23, 201.24, 201.25, 201.26, 201.28, 128/202.27, 205.12, 205.25, 205.27, 205.28, 128/205.29, 206.11–206.13, 206.15, 206.17, 128/206.21, 206.24, 206.28, 206.29, 207.11, 128/207.12, 204.29, 206.27, 204.18, 201.29, 128/206.16; 244/118.5

See application file for complete search history.

(56) References Cited

U.S. PATENT DOCUMENTS 3,621,841 A 11/1971 Austin et al.
3,976,063 A 8/1976 Henneman et al.
4,154,235 A 5/1979 Warncke
4,207,882 A * 6/1980 Lemere ..... 128/206.15
4,552,140 A * 11/1985 Cowley et al. ..... 128/201.25
4,559,939 A 12/1985 Levine et al.
4,610,247 A * 9/1986 Stroup ..... 128/201.28
4,614,186 A 9/1986 John
4,625,721 A 12/1986 Levine et al.
4,771,771 A 9/1988 Walther
4,793,342 A 12/1988 Haber et al.
4,807,614 A 2/1989 van der Smissen et al.
4,811,728 A 3/1989 Von Kopp
5,016,625 A 5/1991 Hsu et al.
5,029,578 A * 7/1991 Swiatosz ..... 128/202.26
5,056,512 A 10/1991 Bower et al.
5,113,854 A 5/1992 Dosch et al.
5,115,804 A 5/1992 Brookman
5,140,980 A 8/1992 Haughey et al.
5,186,165 A 2/1993 Swann
5,315,987 A 5/1994 Swann
5,431,156 A 7/1995 Sundstrom
5,526,804 A 6/1996 Ottestad
5,529,058 A 6/1996 Crippen (Continued)

FOREIGN PATENT DOCUMENTS

CA 1088841 11/1980

(Continued)

*Primary Examiner*—Teena Mitchell
(74) *Attorney, Agent, or Firm*—Nixon & Vanderhye, PC

(57) ABSTRACT

The present invention provides a respirator hood assembly that has a bag, half mask and a respirator assembly. The assembly includes a filtration unit and at least one inlet pipe containing a filter. The assembly of the invention allows for flexible filter design and also defines a rigid external structure that supports the hood and allows the user to quickly don the hood.

30 Claims, 11 Drawing Sheets

U.S. PATENT DOCUMENTS

| | | | | |
|---|---|---|---|---|
| 5,714,126 | A | 2/1998 | Frund | |
| 6,041,778 | A | 3/2000 | Swann | |
| 6,062,221 | A | 5/2000 | Brostrom et al. | |
| 6,233,748 | B1 | 5/2001 | Gieger et al. | |
| 6,302,103 | B1 | 10/2001 | Resnick | |
| 6,340,024 | B1 * | 1/2002 | Brookman et al. .... | 128/201.25 |

FOREIGN PATENT DOCUMENTS

| | | | |
|---|---|---|---|
| CA | 1149258 | | 7/1983 |
| CA | 1180629 | | 1/1985 |
| CA | 1239847 | | 8/1988 |
| CA | 1251375 | | 3/1989 |
| CA | 1268685 | | 5/1990 |
| CA | 1278488 | | 1/1991 |
| CA | 1285452 | | 7/1991 |
| CA | 1322969 | | 10/1993 |
| CA | 1326805 | | 2/1994 |
| CA | 2162227 | | 5/1996 |
| CA | 2084765 | | 11/1996 |
| CA | 2189378 | | 5/1998 |
| EP | 0470791 | A2 | 2/1992 |
| EP | 0327643 | B1 | 10/1994 |
| FR | 2763563 | A1 | 11/1998 |
| GB | 2189152 | A | 10/1987 |
| GB | 2189153 | A | 10/1987 |
| GB | 2189707 | A | 11/1987 |
| GB | 2191950 | A | 12/1987 |
| GB | 2200288 | A | 8/1988 |
| GB | 2201096 | A | 8/1988 |
| GB | 2205506 | A | 12/1988 |
| GB | 2213387 | A | 8/1989 |
| GB | 2233905 | A | 1/1991 |
| GB | 2247396 | A | 3/1992 |
| GB | 2275613 | A | 9/1994 |
| GB | 2 353 480 | A | 2/2001 |

* cited by examiner

RESPIRATOR HOOD ASSEMBLY

This application claims the benefit of U.S. Provisional Application No. 60/383,815, filed May 29, 2002.

FIELD OF THE INVENTION

The invention relates to a respirator hood assembly, for emergency escape comprising a hood, half mask and filter arrangement, and more particularly to a respirator hood assembly that is impermeable to chemical and biological agents and includes positioning means that allow a user to easily and quickly place the assembly in position.

BACKGROUND OF THE INVENTION

Respirator hoods are known in the art and take many shapes and forms. The hoods generally contain an air impermeable enclosure that surrounds the user's head and neck and a filter system that clears the incoming air of any toxic contaminants.

Some hood designs provide an air impermeable enclosure that forms a tent-like structure around the head of the user and the filter system is enclosed within the enclosure. Other hoods known in the art have externally located filter systems.

Respirator hoods generally include a filter canister, for filtering the ambient air, that is in the shape of a can. U.S. Pat. No. 6,041,778 includes such a canister that is used in combination with a hood. These types of units can be awkward for a user and provide a bulky device that may be unevenly weighted by the canister, causing the hood to slip or move which may allow non-filtered air to enter the hood.

Many prior art hoods include several pieces that require precise placement when a user is donning the hood. Such devices may not be appropriate for emergency use since a user will be required to quickly and precisely place the hood over their head with the minimum amount of adjustment and rearrangement possible.

SUMMARY OF THE INVENTION

The present invention provides a respirator hood assembly that comprises a bag, a half mask and an air filtration unit that defines a rigid external structure around at least a portion of the bag that supports the hood and allows the user to quickly don the hood.

Thus the present invention provides a respirator hood assembly comprising a half mask adapted to cover the nose and the mouth of a user, at least one adjustable strap coupled to the assembly for releasably securing and placing the assembly on a user's head and at least one filtration unit rigidly secured to the half mask and in fluid communication with the half mask. The filtration unit has at least one inlet valve to allow the passage of ambient air therethrough, and at least one exhaust valve to allow the passage of expelled air therethrough. The inlet pipe has a flexible end that is removably secured to the inlet valve of the filtration unit and an opposing rigid end having a filter contained within it. The at least one inlet pipe is in fluid connection with the at least one inlet valve and is operable to receive ambient air through it.

The assembly also includes a bag adapted to enclose the head of the user, the half mask being disposed within the bag, the bag has an elastomeric neck seal that is capable of expansion to allow passage over the head and also of contraction to releasably secure and seal the bag to the neck of the user. The at least one filtration unit and the at least one inlet pipe are attached to a lower region of the bag above the neck seal to provide a rigid gripping portion for placing the hood on the user.

Preferably, the respirator hood assembly includes an adjustable strap which is secured at either side of the filtration unit, external of the hood which operates with the rigid gripping portion to place the hood assembly on the user and to secure the half mask in place over the mouth and nose.

The respirator assembly of the invention preferably comprises an embodiment wherein the at least one inlet pipe is flexible to facilitate bending, compression, packaging and storage of the assembly. A preferred form of a flexible inlet pipe comprises a corrugated inlet pipe.

The filtration unit and the inlet pipes (usually two) comprise a rigid structure that is secured to at least a portion of the bag (hood), just above the neck seal. This allows the user to grab the assembly and quickly pull it over the head, adjusting it around the neck and securely positioning the half mask in the right position. The adjustable strap may be held by one hand and tightened with the other hand to secure the mask in place.

In the respirator hood assembly of the invention, the filtration unit may comprise a combination of filters. Preferably the inlet pipe in the unit comprises an activated carbon filter and a particulate filter located between the flexible end and the rigid end of the inlet pipe. More preferably the unit also comprises a filter housing containing a catalytic converter.

In a preferred form of the respirator hood assembly of the present invention, the bag has a viewing window located in the region of the bag adjacent the eyes of the user. This viewing window may be provided by means well known in the art, examples of which include but are not limited to adhesion and welding. The adhesion may be accomplished by lamination, heat sealing, gluing and similar methods.

The preferences set out herein may be combined in any suitable manner to achieve the solution of the invention. As such these combinations form part of the present invention.

BRIEF DESCRIPTION OF THE DRAWINGS

The present invention will be better understood with reference to the attached description and to the accompanying drawings which are used to illustrate the present invention only and should not be used to limit the scope of the accompanying claims. The drawings are as follows:

DETAILED DESCRIPTION OF THE INVENTION

Figure 1:
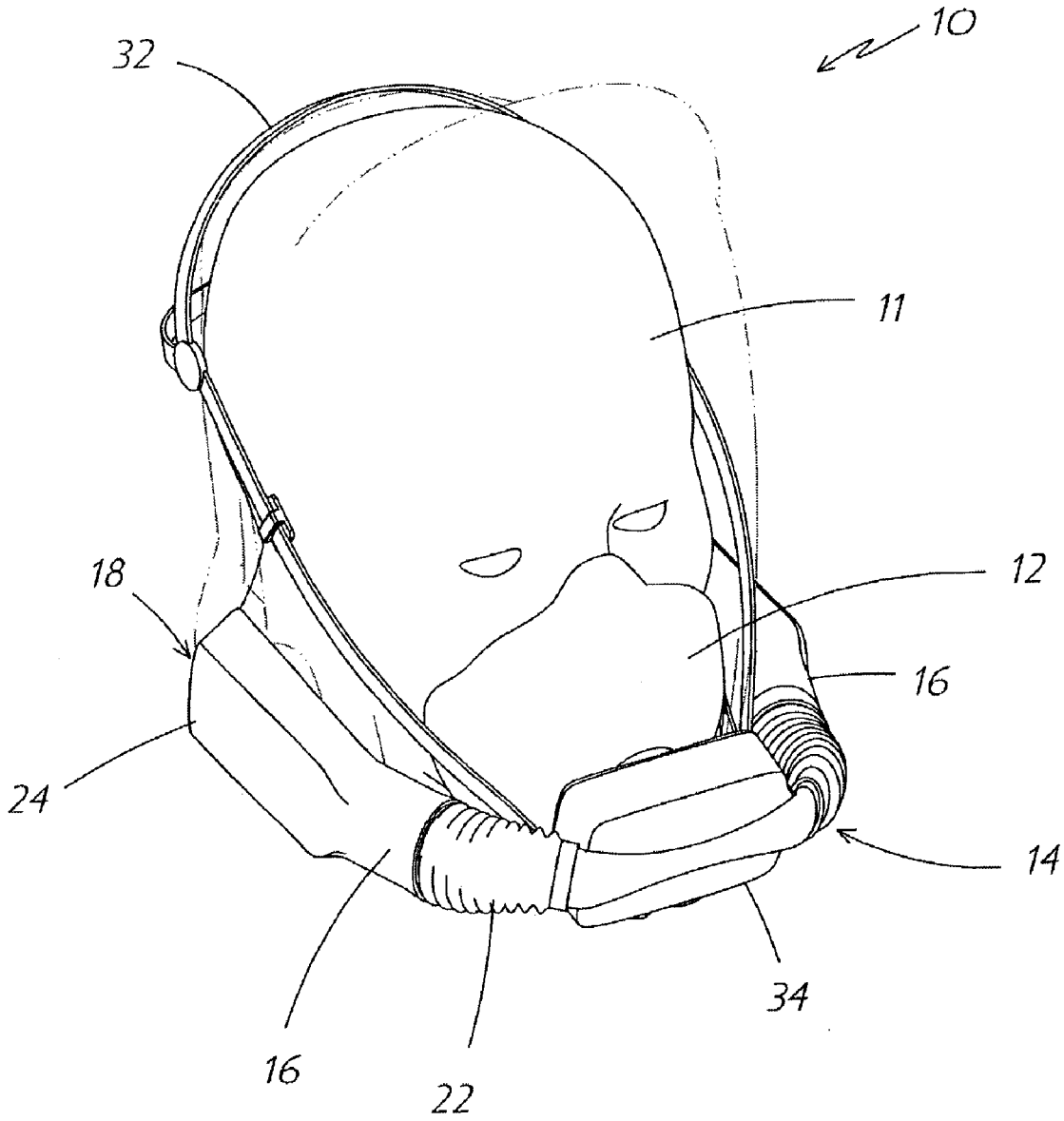
FIG. 1 provides a perspective view of a preferred embodiment of the respirator assembly of the present invention, illustrated in use when placed over the head of a user.
Figure 2:
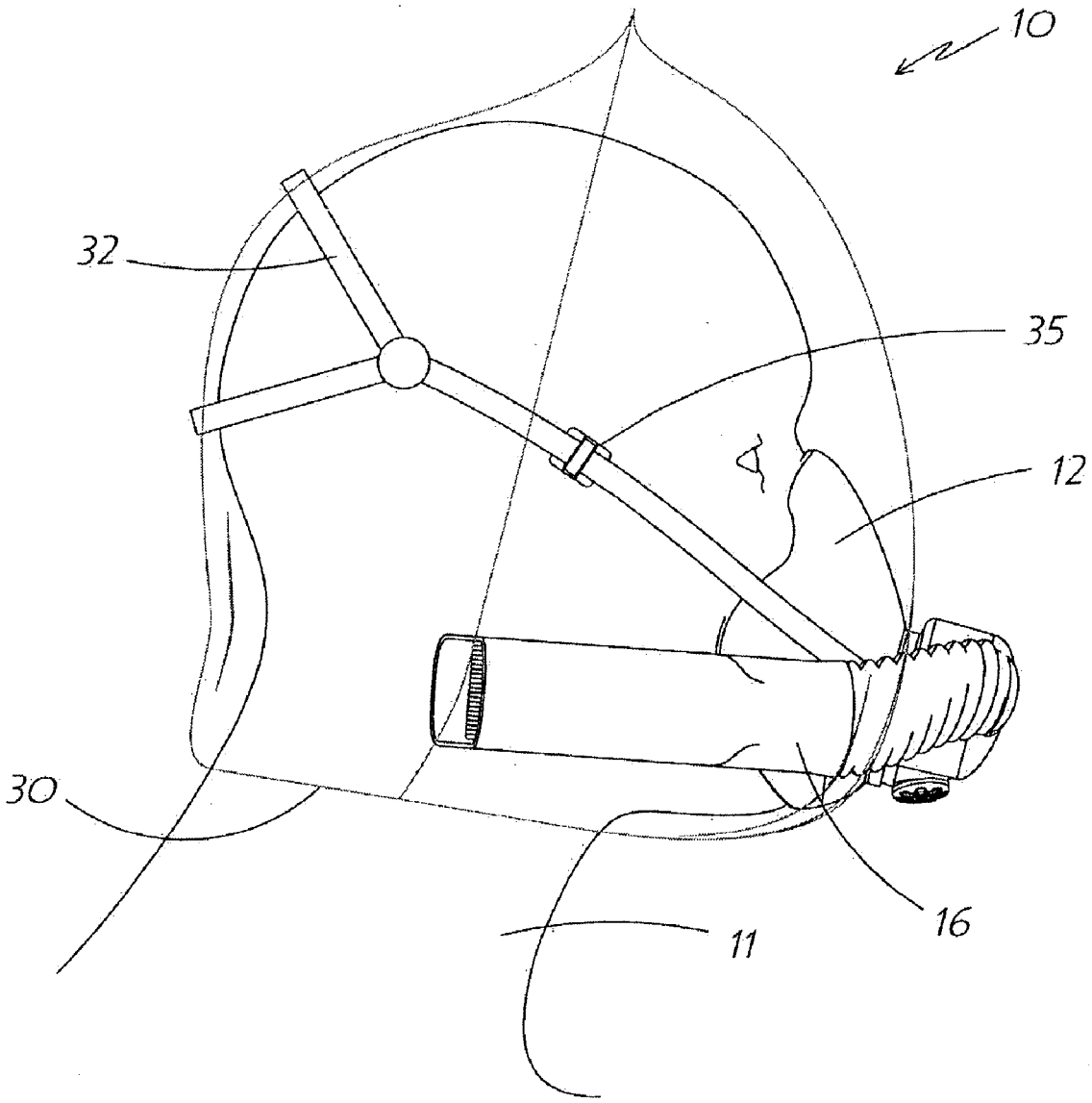
FIG. 2 is a side view of the assembly shown in FIG. 1.

Reference is first made to FIGS. 1 and 2 to describe a preferred embodiment of a respirator hood assembly, in accordance with the invention, designated generally at numeral 10. The assembly 10 is shown in use on a user, indicated generally at 11, for ease of explanation. The respirator hood assembly 10 includes a half mask 12 that is adapted to cover the nose and the mouth of the user 11, and a bag 28 operable to enclose a user's head. It will be understood by a person skilled in the art that the half mask 12 may comprise a separate mouth piece and a nose clamp, not shown, that are known in the art.

The assembly 10 further includes at least one filtration unit 14 that is rigidly secured to and preferably integrally formed with half mask 12. In the preferred embodiment of the invention illustrated, the filtration unit 14 has a filter housing 34 with two inlet pipes 16 provided at either side of the housing 34. These inlet pipes 16 comprise a rigid end 24 and a flexible end 22, preferably of accordion or corrugated configuration. The outer ends of the rigid end 24 comprise external inlet ports 18 by which ambient air is taken into the filtration unit 14. The filtration unit 14 also includes two exhaust valves 20, shown more clearly in FIG. 7, to allow the passage of expelled air out of the filtration unit 14. The filtration unit 14 may include one or more exhaust valves 20 provided that the exhaust valve(s) allow for adequate passage of expelled air from the filtration unit 14.

In the preferred embodiment of the present invention the inlet ports 18 are positioned to extend downwards from the inlet pipe 16, away from the head of the user, when in use. This position ensures that no liquid, for example rain or water in a shower, will enter the inlet port 18. The flexible end 22 of the inlet pipes 16 allows for the hood assembly 10 to collapse into a small size. This is achieved by bending the inlet pipes 16 at the flexible end 22 in on themselves towards each other so that they lie side by side along the side of the filtration unit 14 where the half mask 12 is located. The inlet pipes 16 fold in a manner that is similar to the folding action of the arms of a pair of glasses.

When assembled, the filter housing 34 along with the inlet pipes 16 comprise a rigid element of the assembly which a user can hold onto when positioning the respirator hood assembly 10 on the head, allowing for quick donning of the hood assembly 10. The inlet pipes 16 are preferably attached to the bag 28 along the sides located adjacent the side of a user's head when in use. The attachment may be accomplished by any means that will secure the bag 28 to the inlet pipes 16 without causing any damage to the bag 28, such damage may result in the passage of ambient air directly into the bag. Examples of suitable attachment means are known in the art and include but are not limited to adhesion, spot welding, heat sealing and the like. It will also be understood that the bag 28 does not need to be secured to the inlet pipes 16.

Figure 4:
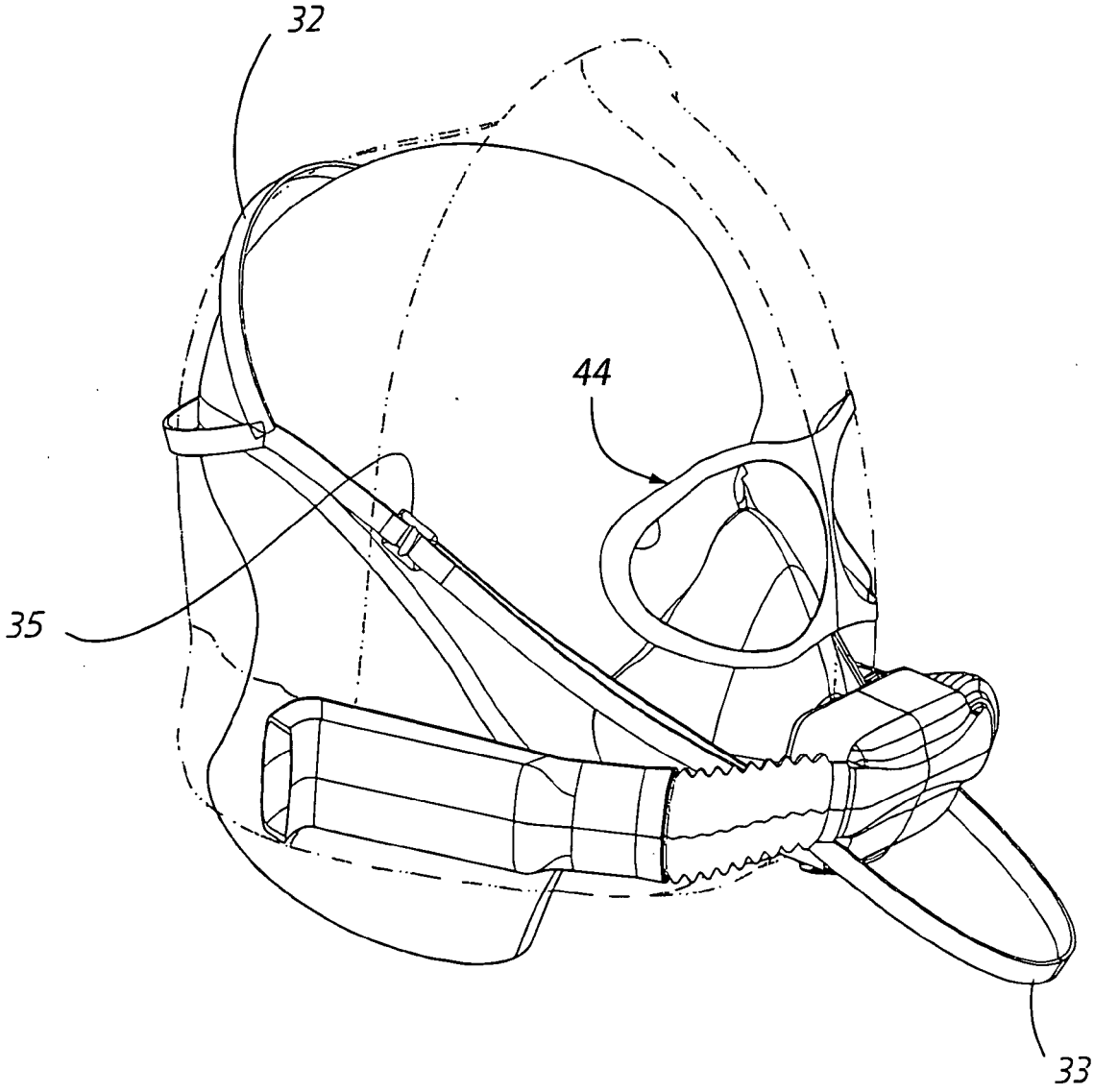
FIG. 4 is a side view of an alternative embodiment of the respirator assembly of the present invention, illustrating the viewing window and an alternative embodiment of the adjustable strap.
Figure 5:
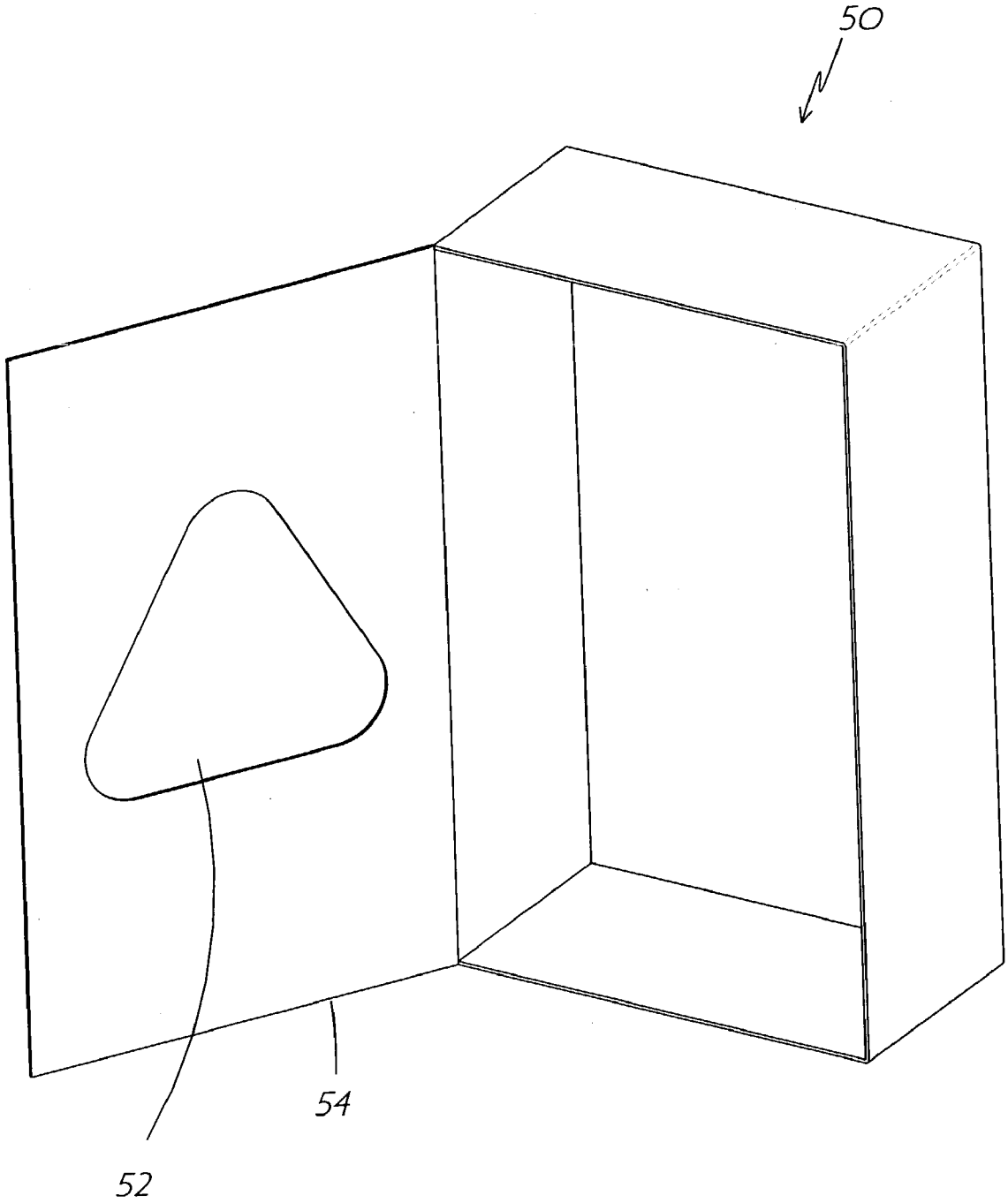
FIG. 5 is a perspective view of a preferred embodiment of a package for a respirator assembly of the present invention.

An adjustable strap 32 is secured to either side of the half mask 12 and around the rear portion of the hood assembly 10 where the back of the user's head is located when the hood assembly 10 is in use. Adjustment of the strap is provided for at the front of the assembly by means of a strap handle 33 (not shown in FIG. 1, but illustrated in FIG. 4) that extends forward from the hood assembly 10. In the preferred embodiment, the strap 32 has a pair of friction stops (not illustrated), or similar means, located on opposite sides of the filter housing 34 that provide a friction fit between the strap 32 and the stops, and secure the strap 32 in position. The friction stops may be any device that provides a friction fit between the strap 32 and the stops in order that when a user tightens the strap 32 by pulling on the handle 33 the strap 32 is held securely in place at the stops by a friction fit, for example a buckle or jam cleat may be used. In order to secure the hood assembly 10 to a user's head, the user can pull forward, away from the face, on the strap handle 33, once the half mask 12 has been positioned over the nose and mouth. This action will in turn pull the strap 32 through the stops until the hood is securely fitted at which point the user can stop pulling on the handle 33 and the stops will securely hold the strap 32 in position. An alternative embodiment of the strap 32 is illustrated in FIG. 4 in which the stops, indicated at 35, are located at a higher position on the strap 32 than that described above. In this position the stops 35 can act as pulleys and when a user pulls on the handle 33, the action will pull the back portion of the bag 28 towards the users head to provide a snug fit, and then the stops 35 will hold the bag in place.

Figure 3:
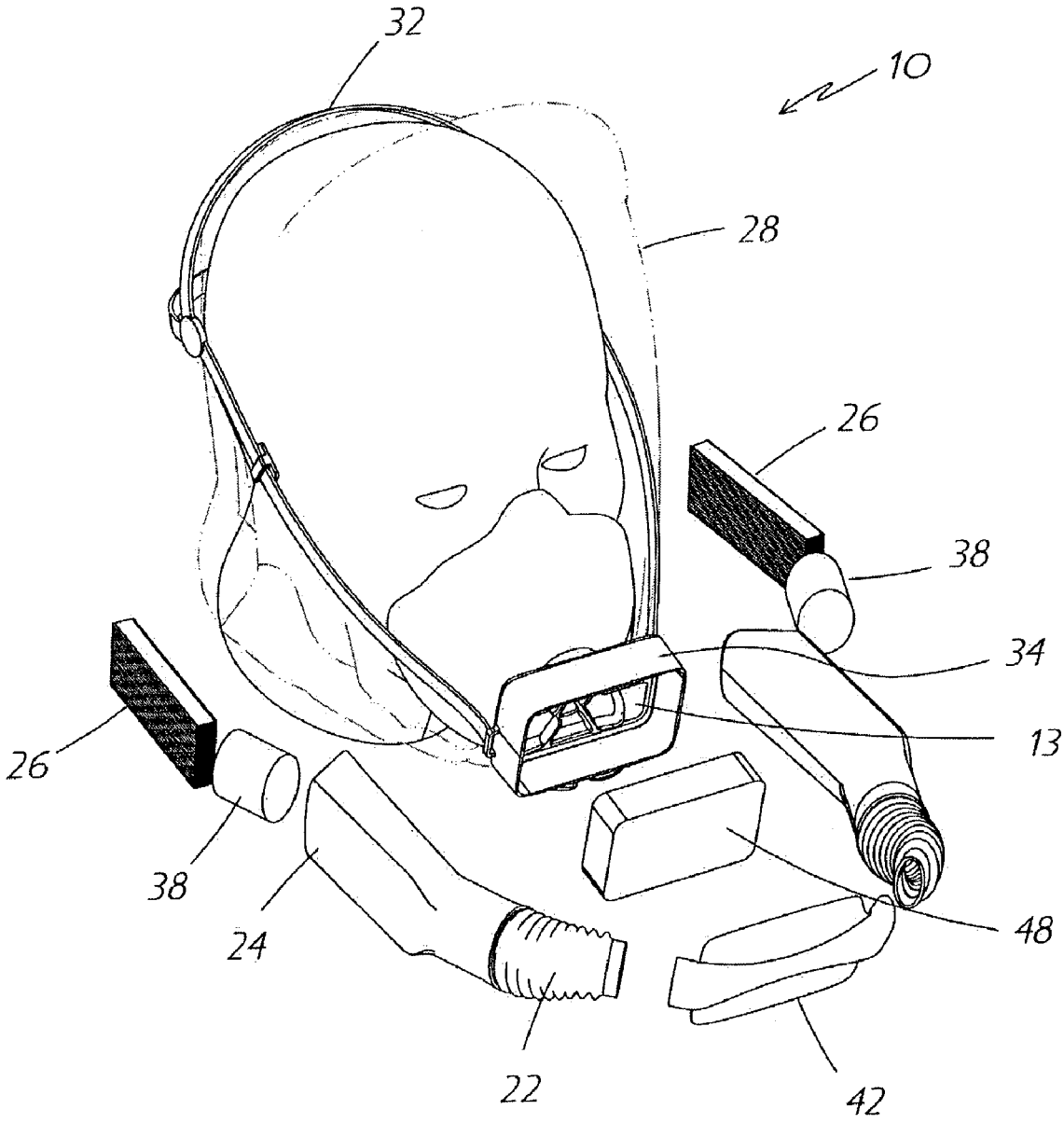
FIG. 3 is an exploded view of the respirator hood assembly of FIG. 1.

Referring now to FIG. 3 the filtration unit 14 of a preferred embodiment will be more clearly explained. The filtration unit 14 comprises a filter housing 34 which houses a catalytic filter 48 located at the mouthpiece 13 of the half mask 12. End cap or manifold cover 42 attaches to filter housing 34 enclosing filter 48. The catalytic filter 48 is preferably a ceramic material that is coated with catalytic material that converts carbon monoxide to carbon dioxide, for example cordierite coated with the catalysts platinum and palladium (Pt/Pd). Other suitable catalytic material, for example zeolite, could be used that would be known to one of skill in the art. The catalytic filter 48 may be a single filter or may be incorporated into the filtration unit 14 in more than one piece depending on the structure of the filtration unit 14 and the end use of the hood assembly 10. The catalytic filter 48 is optional and it will be understood by a person skilled in the art that it may be included for the filtration of carbon monoxide when required.

At the rigid end 24 of the inlet pipes 16, which can be said to act as the external housing for the filters that are contained in the filtration unit 14 and also acting as a donning yolk for the assembly, there is preferably included an activated carbon bed filter 38 which filters by adsorbing or converting chemical agents. The activated carbon bed filter 38 is preferably made from activated and impregnated charcoal, a commercial embodiment of which is an "ASZM TEDA" charcoal, in which the carbon has been coated with metals and organic substances to adsorb and react with chemical and biological agents. This type of filter is known to one of skill in the art and may be coated with different substances for adapting its use to different chemical and/or biological materials or agents.

In addition to the carbon filter 38 there is a high efficiency particulate arrester (HEPA) filter 26. The HEPA filter 26 is typically made from a non-woven structure and may comprise pleated media, unpleated media or a combination of both. The preferred embodiment of the HEPA filter will inhibit particulates including biological agents, aerosolized chemical droplets and radioactive particulates. However, the HEPA filter is not limited to the above description and may be designed to inhibit particulates of varying sizes that will be understood by a person skilled in the art. Both filters 38 and 26 are preferably housed within inlet pipes 16. As can be seen from the alternative embodiments illustrated in FIGS. 1 through 8 and FIGS. 9 through 12, discussed below, varying configurations of the filters 38 and 26 are encompassed within the present invention. For example, the HEPA filter 26 and the carbon filter 38 can be separate units, as shown in FIGS. 1–8. Alternatively, as shown in FIGS. 9–12, the filters 26, 38 can be attached to form one unit in which the filters lie adjacent each other.

The bag 28 of the respirator hood assembly 10 is preferably made from material having low permeability to chemical and biological agents. The bag 28 may also be made from materials that are fire resistant. Examples of suitable materials include, but are not limited to, polyimides such as Kapton™, polyfluorinated materials such as Teflon™, and polyvinyl chlorides. However, the bag may be made from any material that has a low permeability to chemical and biological agents, for example a cloth or fabric coated with a substance that will lower its permeability to such agents.

A viewing window 44 is preferably provided in the bag 28 around where the eye area of a user is positioned when in use, illustrated in FIG. 4. In a preferred embodiment the viewing window 44 is formed of a shape that is similar to that of a pair of eyeglasses, however, any shape may be formed that allows the user to have a clear line of sight through the bag. The window 44 may be integral to the bag 28 or may be constructed separately and attached to the bag 28 by means known in the art, including but not limited to adhesion or welding. The viewing window 44 is made from a transparent material which may be selected from conventional suitable materials such as PVC or polycarbonate. This material may be used for the whole hood, as noted above.

As indicated in FIG. 2, an elastomeric neck seal 30 is attached to the bag 28. The elastomeric neck seal 30 is preferably made of either a strip of rubber formed into a circle or a piece of rubber that has a hole in the middle through which a user's head can pass and which is operable to attach to the neck portion of the bag 28, by means known in the art, for example adhesion or welding. Any material may be used that will have elastomeric properties capable of allowing a user's head to pass through but also operable to secure tightly around the neck to keep any ambient air/debris, etc. outside of the hood assembly 10. An example of a suitable material is Neoprene®. Other examples include but are not limited to butyl rubber or polyurethane, other materials may be used that are known in the art and have the required elastomeric properties and impermeability required for the invention. This neck seal may be secured to the hood material by suitable means such as adhesive or sewing. Appropriate alternative constructions may be selected and would be apparent to a person skilled in the art, the basic requirement being the operative requirement set out above.

In a preferred form of the respirator hood assembly 10, the filter housing 34 and the inlet pipes 16 are made from a polymer impermeable to at least one of chemical agents and biological agents, and preferably both. Typical examples of materials include but are not limited to polycarbonates and thermoplastic polymers of high chemical resistance. Examples of commercial materials are Lexan®, Noryl® and Zytel®.

Figure 6:
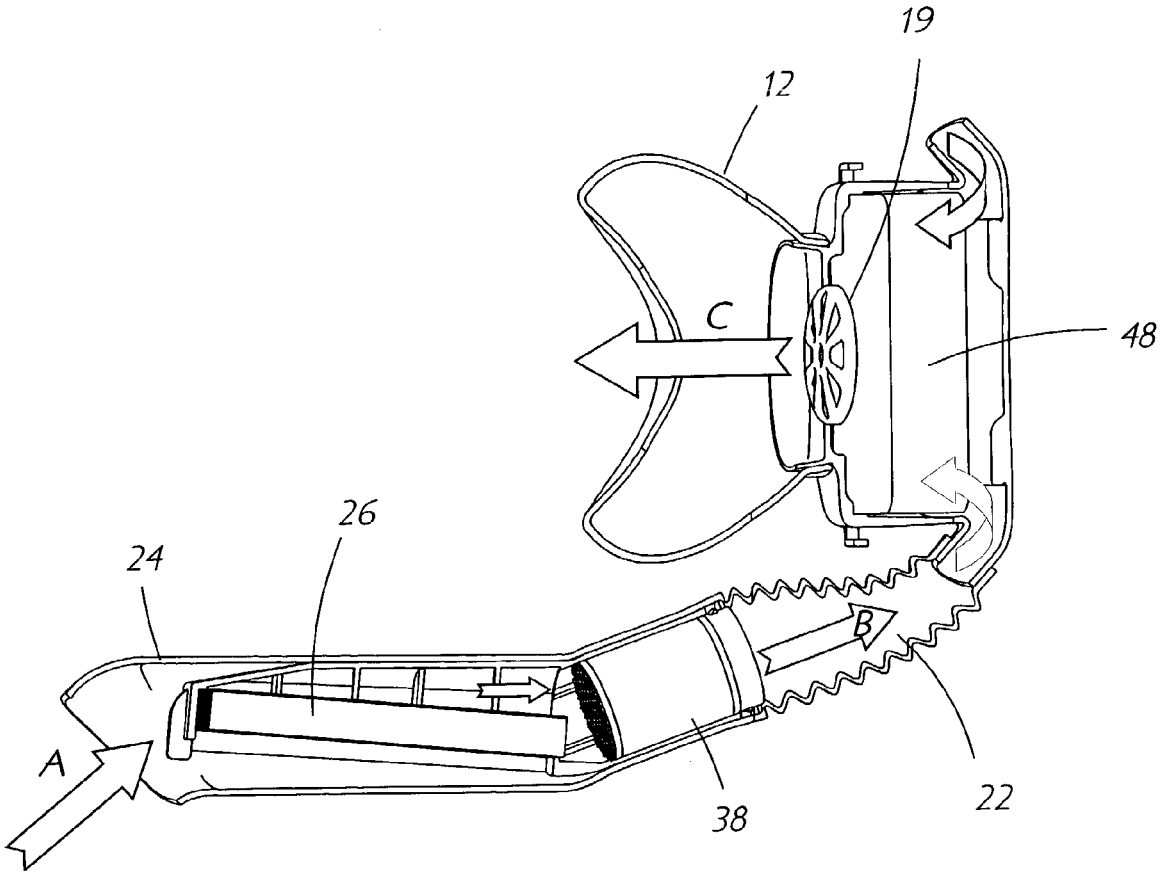
FIG. 6 is a top cross-sectional view of the filtration unit of the respirator hood assembly of FIG. 1.
Figure 8:
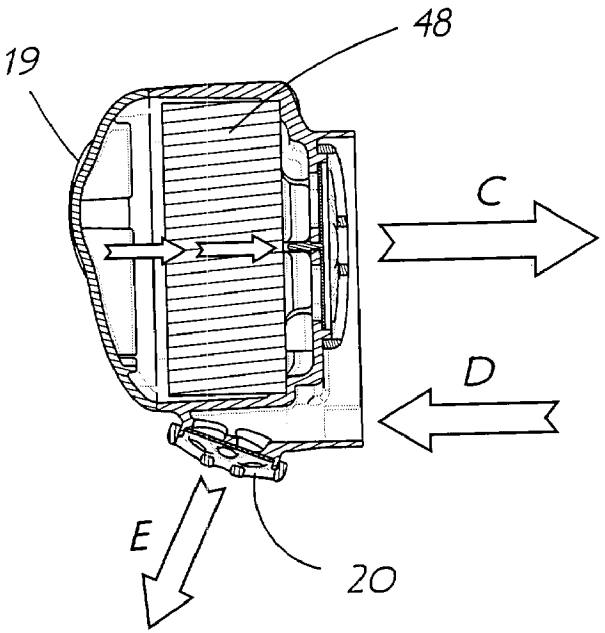
FIG. 8 is a cross-sectional side view of the filter housing of FIG. 7 taken along line 8'—8'.
Figure 7:
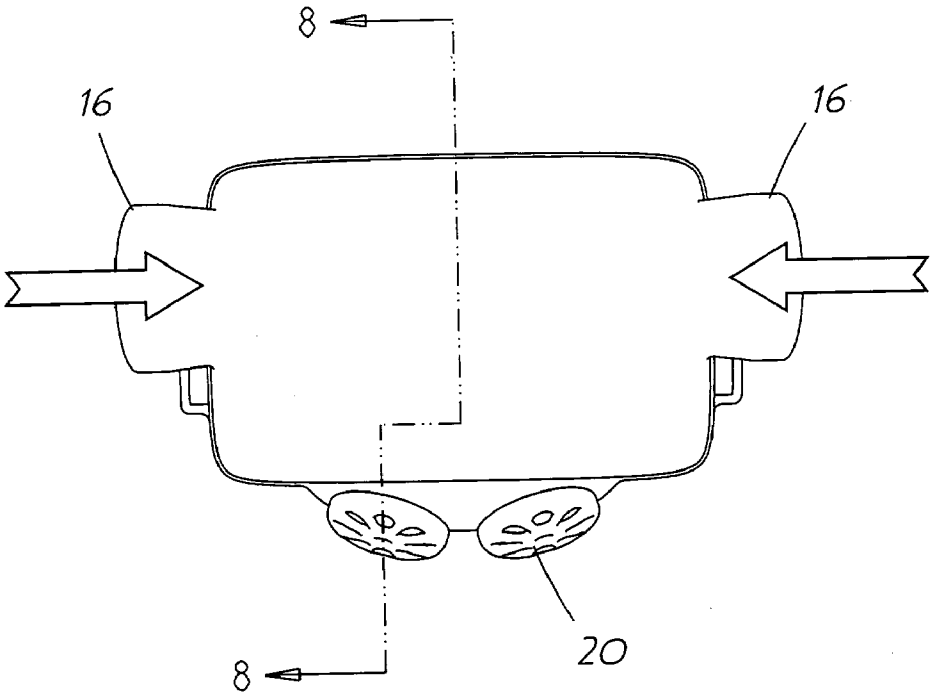
FIG. 7 is a top view of the filter housing of the filtration unit of FIG. 6.

The flow of the ambient air through the filtration unit 14 will now be more clearly discussed with reference to FIGS. 6 through 8. The ambient air flows into the filtration unit 14 at the rigid end 24 of the inlet pipe 16 through the inlet port 18, the flow is indicated in FIG. 6 at arrow A. The air then flows through the HEPA filter 26 and then through the carbon filter 38 and through the inlet pipe 16 towards the flexible end 22, indicated at arrow B. The air then proceeds to flow into the catalytic converter 48 and then flows through an internal inlet valve 19 into the half mask 12, indicated by arrow C in FIGS. 6 and 8, at which point the user is able to inhale the filtered air. The exhaled air leaves the half mask 12 in the direction of arrow D, illustrated in FIGS. 8 and 9, through exhaust valves 20, illustrated by arrow E, into the ambient air. As can be seen from FIGS. 6–8 the air preferably flows from two inlet pipes 16 into the catalytic converter 48, however it will be understood by a person skilled in the art that variations on the number of inlet pipes and valves and exhaust valves may be used to accommodate larger or smaller air flows.

The device of the present invention may be packaged and stored in a specialized package illustrated in FIG. 4 at numeral 50 which provides immediate sizing information for the assembly. The package 50 is such that the suitable size of the half mask 12 can be chosen by using the cut-out 52 located in a front flap portion 54 of the package 50. The cut-out 52 is triangular in shape and is the same size as the half mask 12 located in the package 50, with the distance from the top portion of the triangle to the bottom edge being equivalent to the size of the half mask 12 and reflecting the distance from the bridge of the nose of a user to underneath the jaw bone. The user can ensure that they obtain the correctly sized half mask 12 by placing the cut-out 52 over the bridge of their nose and their jaw bone thereby ensuring that the half mask 12 located in the package 50 will correctly fit them. The assembly is sized for small, medium and large persons, with the fit of the half mask 12 around the nose and mouth being the most important aspect for fit purposes. In addition, the structure, particularly the inlet pipes 16 are designed so that it can be compressed and therefore be more easily stored, as described above.

An alternative embodiment will now be discussed with reference to FIGS. 9 through 12. Reference numerals for the same structures have been increased by 100. It will be understood that such structures perform the same function as those described above and may be made of similar material as described above.

As described above, the respirator hood assembly 110 includes a half mask 112 that is adapted to cover the nose and the mouth of a user 111, and a bag 128 operable to enclose a user's head. The assembly 110 further includes at least one filtration unit 114 that is rigidly secured to and preferably integrally formed with half mask 112. In the embodiment of the invention illustrated, the filtration unit 114 has a filter housing 134 with two inlet pipes 116 provided at either side of the housing 134. These inlet pipes 116 comprise a rigid end 124 and a flexible end 122, preferably of accordion or corrugated configuration. The outer ends of the rigid end 124 comprise external inlet ports 118, shown in FIG. 10, by which ambient air is taken into the filtration unit 114. The inlet ports 118 are located on the lower surface of the rigid end 124 of the inlet pipes 116. The filtration unit 114 has an exhaust valve 120 to allow the passage of expelled air out of the filtration unit 114. Likewise, the inlet pipes 116 are operable to bend in on themselves, as discussed above, so that they lie side by side along the side of the filtration unit 114.

The hood assembly 110 also includes an adjustable strap 132, with stops 135, secured to either side of the half mask 112 and around the rear portion of the hood assembly 110 where the back of the user's head is located when the hood assembly 110 is in use. The hood assembly also includes an elastomeric neck seal 130, as described above.

Figure 9:
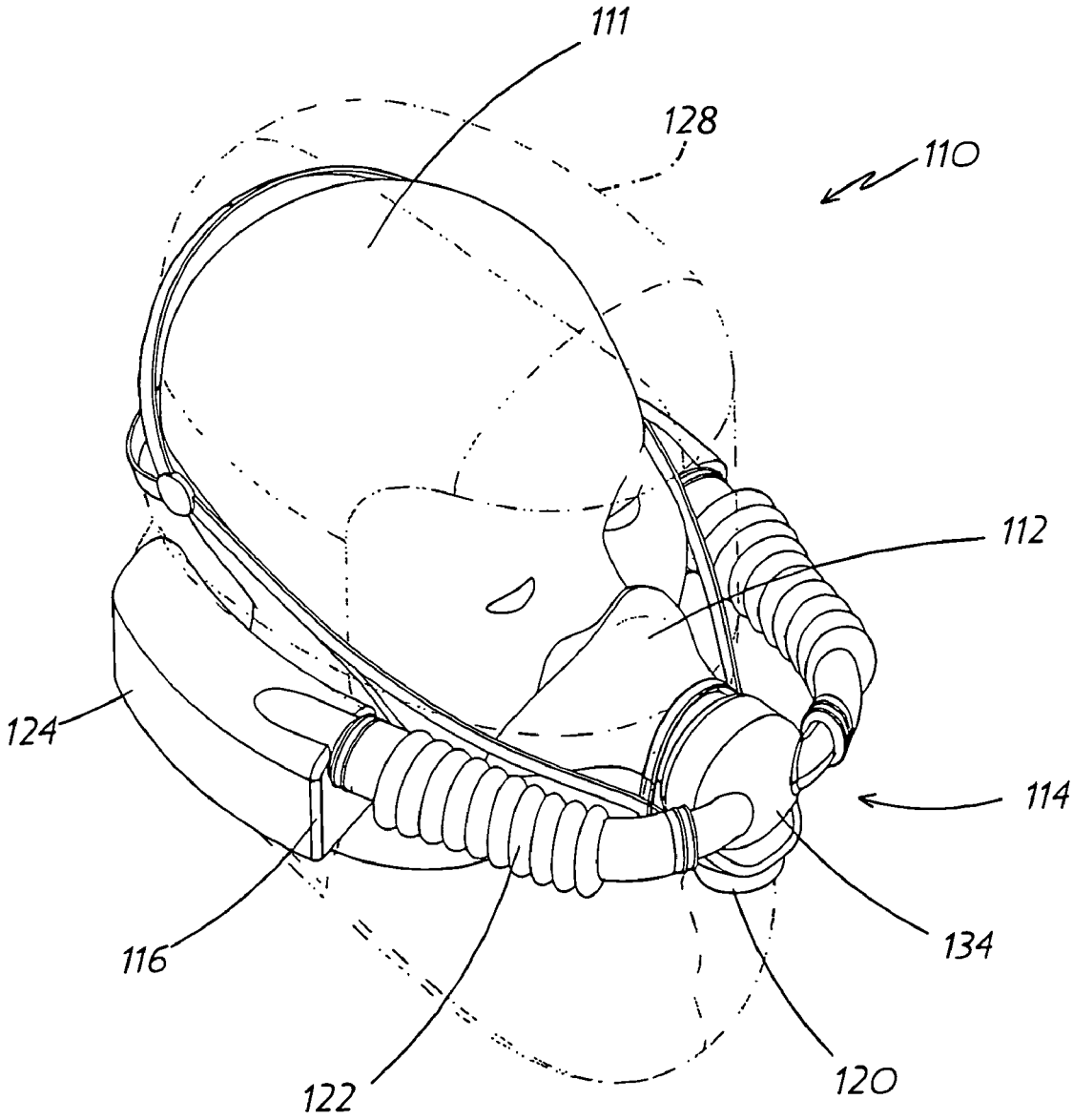
FIG. 9 provides a perspective view of an alternative embodiment of the respirator assembly of FIG. 1, illustrate in use when placed over the head of a user.
Figure 10:
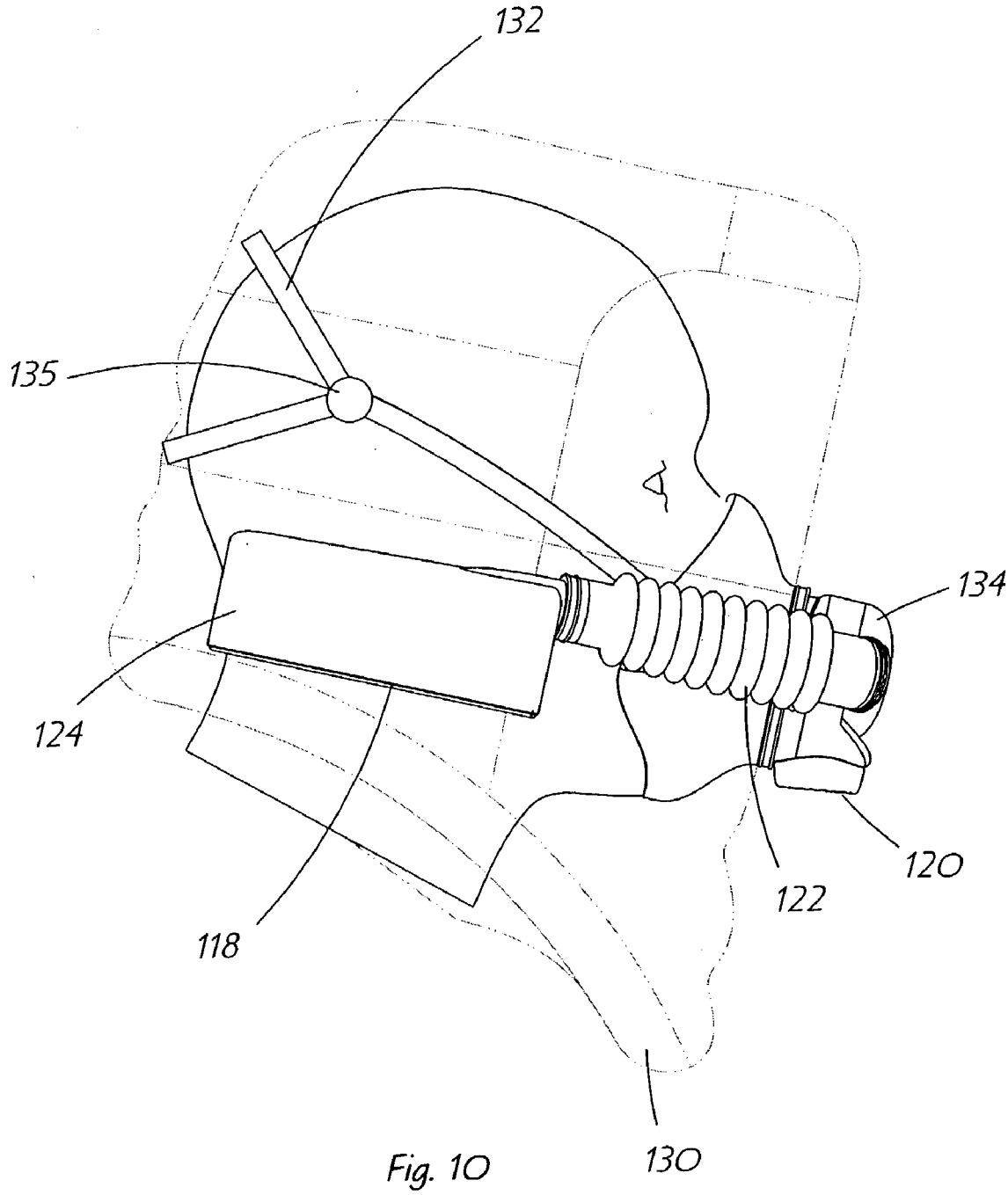
FIG. 10 is a side view of the respirator hood assembly of FIG. 9.
Figure 11:
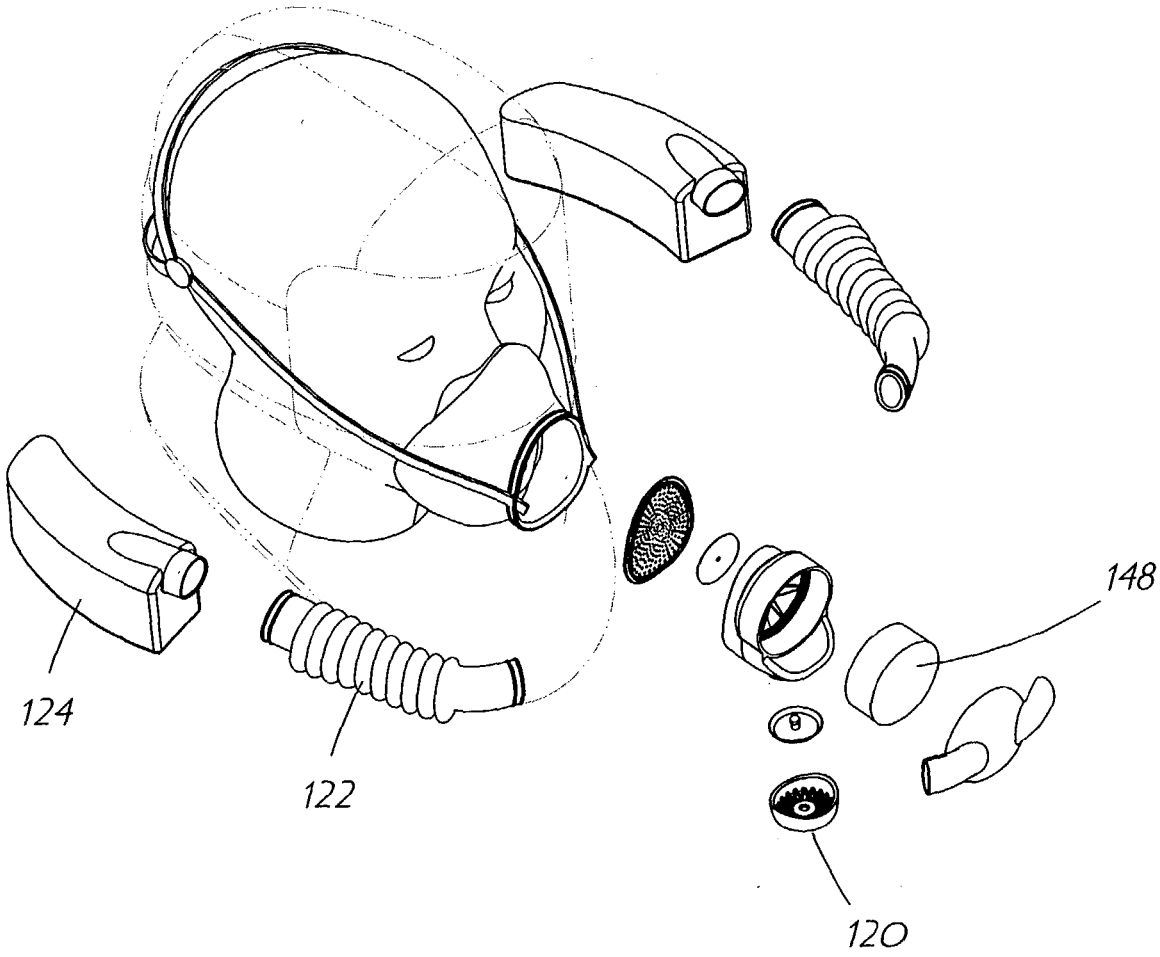
FIG. 11 is an exploded view of the respirator hood assembly of FIG. 10.

As can be seen in FIGS. 9 through 11, the filter housing 134 may be circular in shape. It will be understood by a person skilled in the art that the filter housing 134 performs the same function as filter housing 34 and may also include a catalytic filter 148. The filter housing 134 may form any shape or structure that is operable to perform the same function as that discussed above for filter housing 34.

Figure 12:
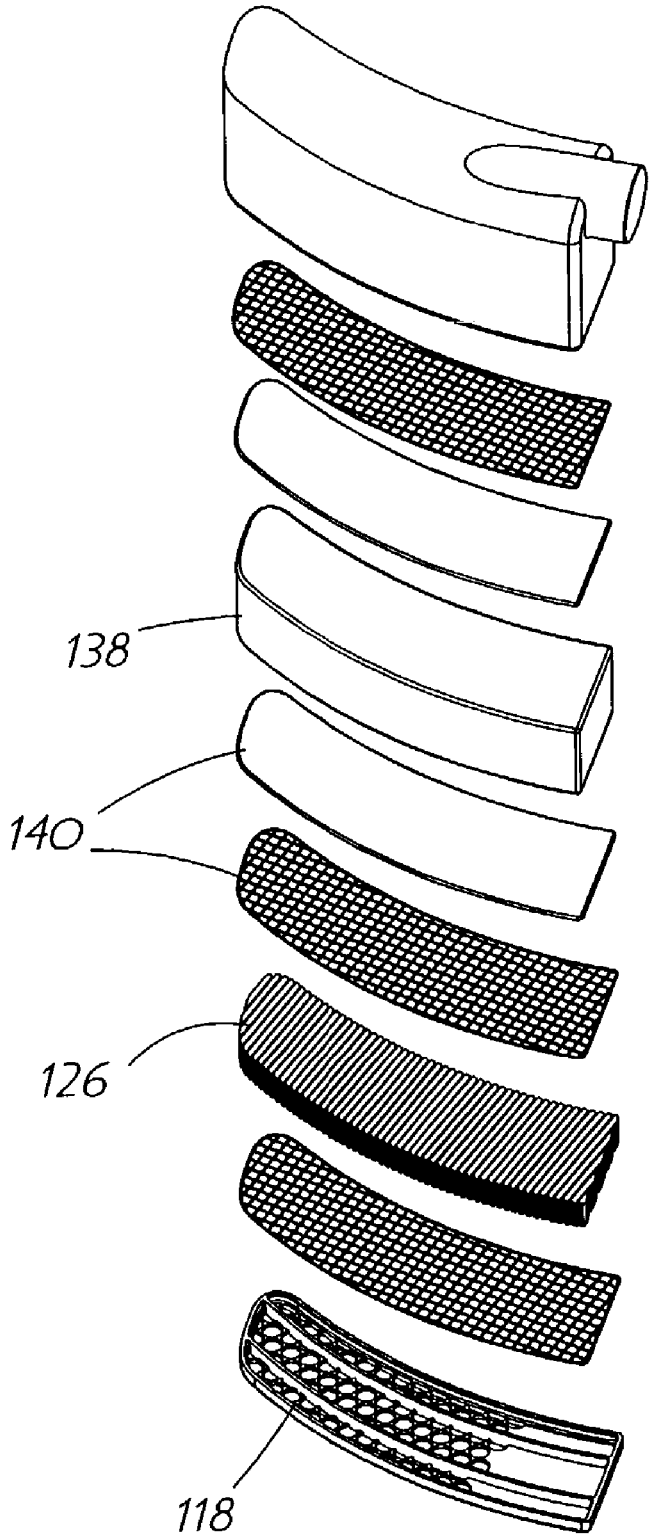
FIG. 12 is an exploded view of the filtration unit of the respirator hood assembly of FIG. 9.

Turning to FIGS. 11 and 12 the configuration of the filters 26 and 38 will be discussed in more detail. In this embodiment the flexible end 122 and the rigid end 124 of the inlet pipes 116 may be formed from separate components that may be releasable attached to each other. It will be understood that the ends 122 and 124 may also be integrally formed. As can be seen in FIG. 12, the HEPA filter 126 and the carbon filter 138 lie in parallel configuration within the rigid end 124 with the HEPA filter 126 lying adjacent the inlet ports 118 and the carbon filter 138 lying on top of the HEPA filter 126. In this configuration the ambient air will flow through inlet ports 118 into the HEPA filter 126 and then into the carbon filter 138 and then flow through the end of the carbon filter 138 out of the rigid end 124 of inlet pipe 116 and into the flexible end 122. The air will then flow through the filtration unit 114 as described above.

FIG. 12 illustrates the filters 126, 138 with a series of layered separation sheets 140 therebetween. The separations sheets 140 may act as screens and/or filters and may be made from material that provides additional filtration of the air as it flows between the inlet ports 118 and the flexible end 122, for example the sheets 140 may be made from non-woven material capable of filtering fine particles that may be present in the air. Alternatively the separation sheets 140 may be used to separate the interface of the filters 126, 138 and therefore made from material that will not inhibit the operation of the filters 126, 138 or inhibit the flow of air therebetween.

It will be understood by a person skilled in the art that several configurations of the filters 126, 138 can exist and form part of the present invention. For example, the filters 126, 138 may lie adjacent each other within the rigid end 124 of inlet pipes 116 with the inlet ports 118 feeding air into the HEPA filter 126.

The use of the hood assembly 10 will now be discussed.

In operation, the assembly 10 is removed from its storage package 50 and the inlet pipes 16 are unfolded in a manner similar to unfolding the arms of a pair of glasses, to open up the hood assembly 10. The assembly 10 is shaken out to put air into the bag 28 and to allow access to the adjustable strap 32 and rigid gripping portion provided by the filtration unit 14 and the inlet pipes 16 for quick and secure donning of the assembly by a user. The user holds the sides of the rigid gripping portion defined by the inlet pipes 16 and places the head of the user into the bag 28 to position the half mask 12 over the nose and mouth of the user and then the strap 32 is adjusted, as described above, to secure the half mask 12 in the required position. Once the half mask 12 is positioned about the head and the strap 32 is secured, then the user adjusts the neck portion 30 so that it is lying flat around the neck of the user. All of this operation is meant to occur in very rapid time, since it is anticipated that the respirator hood assembly 10 of the invention would be used by individuals who wish to quickly evacuate from a building, such as a high rise building, where air quality would provide a risk to the user. Typically, the filtration unit 10 is designed for the amount of time required to exit a typical high rise building, and thus an average time of 20 minutes is envisaged for operation of the filtration unit when the respirator hood assembly is in place on a user. Obviously, the time and hence filter capacity can be varied appropriately to allow for longer or shorter usage times, including, but not limited to, standard escape times 15, 30 and 60 minutes.

The preferred embodiment of the present invention is designed to be disposable and for one time use only, however, the assembly may be made to include filters that can be replaced or a whole filtration unit that can be removed from the half mask and bag and replaced with a new filtration unit. In order to allow for the replacement of parts connections may be provided within the assembly that allow for easy removal of parts. For example, the filter housing may be connected to the half mask and the inlet pipes by a fitting such as a snap fit or a screw fit, both of which would allow for the removal and replacement of the housing.

The above described embodiments of the invention are intended to be examples of the present invention and alterations and modifications may be effected thereto, by those of skill in the art, without departing from the scope of the invention. For example, the hood assembly may comprise any combination of filters disclosed above, that can be located within the filtration unit in any order. Each filter may be adapted to provide specific capabilities depending on the intended end use. For example, the filtration unit may comprise more then one particulate filter, where each filter is operable to inhibit the passage of varying particulate sizes. The carbon filter may be adapted to contain agents that will only respond to specific chemical or biological agents, depending on the situation envisaged for the use of the hood assembly.

Each half mask may be made of varying sizes to allow for size variations in the facial structure of the users. Examples of suitable materials that may be used for the half mask include, but are not limited to, Alcryn®, butyl rubber and silicone rubber. The elastomeric neck seal may also be made of varying sizes to accommodate varying sizes of neck in the users. Each filter contained within the hood assembly should be made to maximize its potential use and ensure that the face velocity of each filter is suitably adequate to provide a low breathing resistance. In the case of the catalytic filter, the filter should be made having a face velocity adequate to allow for catalytic conversion of the contaminants.

The filtration unit, including the inlet pipes, should be made to provide the rigid outer structure that assists the user in placing the hood assembly securely over their head. The filtration unit may be made from any shape that provides this additional rigid structure and can contain the filters within it and allow the ambient air to flow through the inlet valves to pass through all of the filters before entering the half mask. The inlet pipes may also be made from, for example, aluminum or polymers reinforced with glass fibres, or other suitable material including those discussed above, that have a low permeability to chemical and/or biological agents and will provide a suitable housing for the filters.

The invention claimed is:

1. A respirator hood assembly comprising:

a half mask adapted to cover a user's nose and mouth;

at least one adjustable strap coupled to the assembly for releasably securing and placing the assembly on the user's head;

at least one filtration unit integrally coupled to the half mask and in fluid communication therewith, at least one of the half mask and the at least one filtration unit having at least one inlet valve to allow the passage of ambient air therethrough, and the at least one filtration unit having at least one exhaust valve to allow the passage of expelled air therethrough;

at least one inlet pipe having a flexible end removably secured to the at least one inlet valve and an opposing rigid end having at least one filter contained therein, the at least one pipe being in fluid connection with the at least one inlet valve and open adjacent the rigid end thereof to receive ambient air therethrough; and a bag adapted to enclose the head of the user with the half mask being disposed within the bag, the bag having an elastomeric neck seal for releasable securing and sealing the bag to the neck of the user, the at least one filtration unit being attached to a lower region of the bag above the neck seal and the at least one inlet pipe both extending exteriorly of and about the lower region of the bag above the neck seal in a circumferential direction and to one side of and rearwardly of the filtration unit to provide an external rigid gripping portion along said one side of the hood assembly for placing the hood on the user.

2. A respirator hood assembly according to claim 1, wherein the adjustable strap is secured at either side of the filtration unit, exterior of the hood and operates with the rigid gripping portion to place the hood assembly on the user and secures the half mask in place.

3. A respirator hood assembly according to claim 2, wherein the adjustable strap includes a strap adjustment loop provided at the front of the assembly which upon pulling tightens the back of the strap against a user's head and brings the half mask tightly against a user's face.

4. A respirator hood assembly according to claim 2, wherein the adjustable strap comprises at least one friction stop operable to frictionally engage the strap when the user adjusts the strap length.

5. A respirator hood assembly according to claim 1, wherein the at least one inlet pipe is collapsible to facilitate packing and storage.

6. A respirator hood assembly according to claim 5, wherein the at least one inlet pipe is corrugated.

7. A respirator hood assembly according to claim 1, wherein the filtration unit comprises a filter housing containing a catalytic converter.

8. A respirator hood assembly according to claim 1, wherein the at least one inlet pipe further comprises at least one of an activated carbon filter and a particulate filter located between the flexible end and the rigid end of the inlet pipe.

9. A respirator hood assembly according to claim 8, wherein the particulate filter is a high efficiency particulate arrester filter.

10. A respirator hood assembly according to claim 8, wherein the particulate filter inhibits at least one of biological particulates, aerosolized chemical droplets and radioactive particulates.

11. A respirator hood assembly according to claim 1, wherein the at least one inlet pipe further comprises an inlet port located at the rigid end to allow for the passage of ambient air therethrough.

12. A respirator hood assembly according to claim 11, wherein the inlet port extends downwardly from the hood assembly towards the eyes of the user.

13. A respirator hood assembly according to claim 1, wherein the bag has a viewing window located in the region of the bag adjacent the eyes of the user.

14. A respirator hood assembly according to claim 1, wherein the bag is impermeable to at least one of chemical agents and biological agents.

15. A respirator hood assembly according to claim 1, wherein the bag is made from a material having low permeability to chemical and biological agents.

16. A respirator hood assembly according to claim 1, wherein the filter housing is made from a polymer impermeable to at least one of chemical agents and biological agents.

17. A respirator hood assembly according to claim 1, wherein the hood assembly is disposable and for a one-time use.

18. A respirator hood assembly according to claim 1, wherein the half mask comprises a mouthpiece and a nose clamp.

19. A respirator hood assembly according to claim 1, wherein two inlet pipes are provided, the flexible end of each removably secured to a respective inlet valve of the filtration unit.

20. A respirator comprising:

a half mask adapted to cover a user's nose and mouth;

at least one adjustable strap coupled to the respirator for releasably securing and placing the assembly on the user's head;

at least one central filtration unit integrally coupled to the half mask and in fluid communication therewith, at least one of the half mask and the at least one central filtration unit having at least two inlet valves to allow the passage of ambient air therethrough, and the at least one central filtration unit having a central filter and at least one exhaust valve to allow the passage of expelled air therethrough;

at least two inlet pipes, each removably secured to the at least two inlet valves of the at least one central filtration unit and each of the at least two inlet pipes having at least one inlet filter contained therein in series with said central filter, each of the at least two pipes being in fluid connection with each of the respective at least two inlet valves to receive ambient air therethrough.

21. The respirator according to claim 20, wherein the central filter is a catalytic converter.

22. The respirator according to claim 21, wherein each of the at least two inlet pipes have at least one of an activated carbon filter and a particulate filter.

23. The respirator according to claim 22, wherein each of the at least two inlet pipes have both an activated carbon filter and a particulate filter.

24. The respirator according to claim 22, wherein the particulate filter is a high efficiency arrester filter.

25. The respirator according to claim 20, wherein the at least two inlet pipes each have a flexible end that is removably secured to the respective inlet valve.

26. The respirator according to claim 25, wherein the at least two inlet pipes each have a rigid end having the inlet filter contained therein.

27. The respirator according to claim 26, further comprising a bag adapted to enclose the head of the user, the half mask being disposed within the bag and the bag having an elastomeric neck seal for releasably securing and sealing the bag to the neck of the user.

28. The respirator according to claim 27, wherein the at least one filtration unit and the at least two inlet pipes are attached to a lower region of the bag above the neck seal.

29. The respirator according to claim 20, wherein there is one filtration unit having a catalytic converter and two inlet pipes.

30. A respirator comprising:

a half mask adapted to cover a user's nose and mouth;

at least one adjustable strap coupled to the respirator for releasably securing and placing the assembly on the user's head;

at least one central filtration unit integrally coupled to the half mask and in fluid communication therewith, at least one of the half mask and the at least one central filtration unit having at least two inlet valves to allow the passage of ambient air therethrough, and the at least one central filtration unit having a central filter and at least one exhaust valve to allow the passage of expelled air therethrough;

at least two inlet pipes, each removably secured to the at least two inlet valves of the at least one central filtration unit and each of the at least two inlet pipes having at least one inlet filter contained therein in series with said central filter, each of the at least two pipes being in fluid connection with each of the respective at least two inlet valves to receive ambient air therethrough; and a bag for enclosing the head of the user with the half mask disposed within the bag, the bag having an elastomeric neck seal for releasable securing and sealing the bag to the neck of the user, the at least one filtration unit being attached to a lower region of the bag above the neck seal and the at least two inlet pipes extending exteriorly of and about the lower region of the bag above the neck seal in opposite circumferential directions along opposite sides of and rearwardly of the at least one filtration unit to provide rigid gripping portions along opposite sides of the hood assembly for placing the respirator hood assembly on the user's head.

* * * * *